US006367247B1

(12) United States Patent
Yancey

(10) Patent No.: US 6,367,247 B1
(45) Date of Patent: Apr. 9, 2002

(54) AIR ENGINE

(76) Inventor: Don M. Yancey, 7842 Denise Cir., La Palma, CA (US) 90623

( * ) Notice: Subject to any disclaimer, the term of this patent is extended or adjusted under 35 U.S.C. 154(b) by 0 days.

(21) Appl. No.: 09/579,326

(22) Filed: May 25, 2000

(51) Int. Cl.[7] ..... F16D 31/02

(52) U.S. Cl. ..... 60/412; 415/73; 416/176; 417/374

(58) Field of Search ..... 60/412, 407, 370; 417/374; 415/72, 73, 202; 416/176

(56) References Cited

U.S. PATENT DOCUMENTS

| | | | | |
|---|---|---|---|---|
| 2,839,269 A | | 6/1958 | Gillen | |
| 2,966,776 A | | 1/1961 | Taga | |
| 3,290,884 A | | 12/1966 | Rainey | |
| 3,563,032 A | | 2/1971 | La Pointe | |
| 3,688,859 A | | 9/1972 | Hudspeth et al. | |
| 3,697,190 A | * | 10/1972 | Haentjens | 415/72 |
| 3,847,058 A | | 11/1974 | Manor | |
| 3,885,387 A | * | 5/1975 | Simington | 60/412 |
| 3,925,984 A | | 12/1975 | Holleyman | |
| 3,980,152 A | | 9/1976 | Manor | |
| 4,014,172 A | | 3/1977 | Jones | |
| 4,018,050 A | * | 4/1977 | Murphy | 60/412 |
| 4,043,126 A | | 8/1977 | Santos | |
| 4,124,978 A | | 11/1978 | Wagner | |
| 4,370,857 A | | 2/1983 | Miller | |
| 4,651,525 A | | 3/1987 | Cestero | |
| 4,715,181 A | * | 12/1987 | Cestero | 60/412 |
| 4,798,053 A | | 1/1989 | Chang | |
| 5,312,224 A | * | 5/1994 | Batchelder | 415/72 |
| 5,957,234 A | | 9/1999 | Manor | |

* cited by examiner

*Primary Examiner*—F. Daniel Lopez
*Assistant Examiner*—Igor Kershteyn
(74) *Attorney, Agent, or Firm*—William W. Haefliger

(57) ABSTRACT

Apparatus for supplying high pressure gas to an engine, to operate the engine, including in combination a gas pressurizer having a low gas pressure inlet to receive inlet gas, as for example discharge gas from the engine, and a high gas pressure outlet to deliver supply gas at high pressure to the engine, the pressurizer including a rotary body defining a gas flow channel that extends about an axis in a spiral of decreasing radius, and a drive operatively connected with the body to rotate the body about an axis, at high velocity, to effect gas flow and pressure increase, along the channel, for supply to the engine via an outlet from the pressurizer.

14 Claims, 5 Drawing Sheets

18
16a
16b
16
40a
13
40
12
11
17
~25~
14
26
15
26a
10a
27
62
50'
27
17a
10

AIR ENGINE

BACKGROUND OF THE INVENTION

This invention relates generally to operation of engines, and more particularly to engines driven by non-combustible gas, one example being compressed air.

There is great need for reducing the air polluting effects of internal combustion engine exhaust. Automobile and truck reciprocating piston engines are primary causes of such pollution. Incomplete combustion of fuel/air mixtures supplied to engine cylinders is a problem, in this regard. There is need for improved engine apparatus that will alleviate such problems and difficulties. In particular, there is need for the improved apparatus as disclosed herein, as well as its functioning, and improved results.

SUMMARY OF THE INVENTION

It is a major object of the invention to provide improved apparatus for supplying gas, as for example non-hydrocarbon gas, to an engine, to operate the engine, and in the manner disclosed herein. Basically, the improved apparatus comprises:

a) a gas pressurizer having a low gas pressure inlet to receive inlet gas as for example discharge gas from the engine, and a high gas pressure outlet to deliver supply gas at high pressure to the engine, b) the pressurizer including a rotary body defining a gas flow channel that extends in a spiral of decreasing radius about an axis, and c) a drive operatively connected with that body to rotate the body about its axis, at high velocity, thereby to effect gas flow and pressure increase, along the spiral channel, for supply to the engine via an outlet from said pressurizer.

As will be seen, the body is typically generally conical, about its axis; and the cross-sectional area of the rotating channel decreases along the channel length, for pressurizing the gas, such as air, along the rotating channel length, such rotation typically being at very high RPM, such as in excess of about 12,000 RPM.

A further object includes provision of a drive in the form of an electric motor that drives the body at RPM in excess of 12,000 RPM. The drive may also include a pneumatic drive operatively connected to the body, to take advantage of air pressure at reduced levels, as discharged from the engine. Vanes may be positioned in the rotating pressurized body to receive thrust as via jets, from air exhausted from the engine.

Yet another object includes provision of an impeller associated with the pressurizer to receive low pressure gas and to pressurize and deliver gas to the spiral channel, to flow therealong; and the impeller may be connected to the drive or body, to be rotated by the drive or body.

An additional object includes provision of ducting receiving air at reduced pressure discharged from the engine, and to supply such air to the pressurizer inlet.

A further object includes provision of a high pressure gas storage zone receiving gas from said pressurizer outlet. At least one gas pressure regulator may be provided to receive gas from the high pressure storage zone, to reduce such pressure for supply to the engine. The engine may include compressed air injectors receiving pressurized air flow via the regulator or regulators, for controlled supply to the engine cylinders, to drive the engine pistons.

These and other objects and advantages of the invention, as well as the details of an illustrative embodiment, will be more fully understood from the following specification and drawings, in which:

DRAWING DESCRIPTION

DETAILED DESCRIPTION

Figure 1:
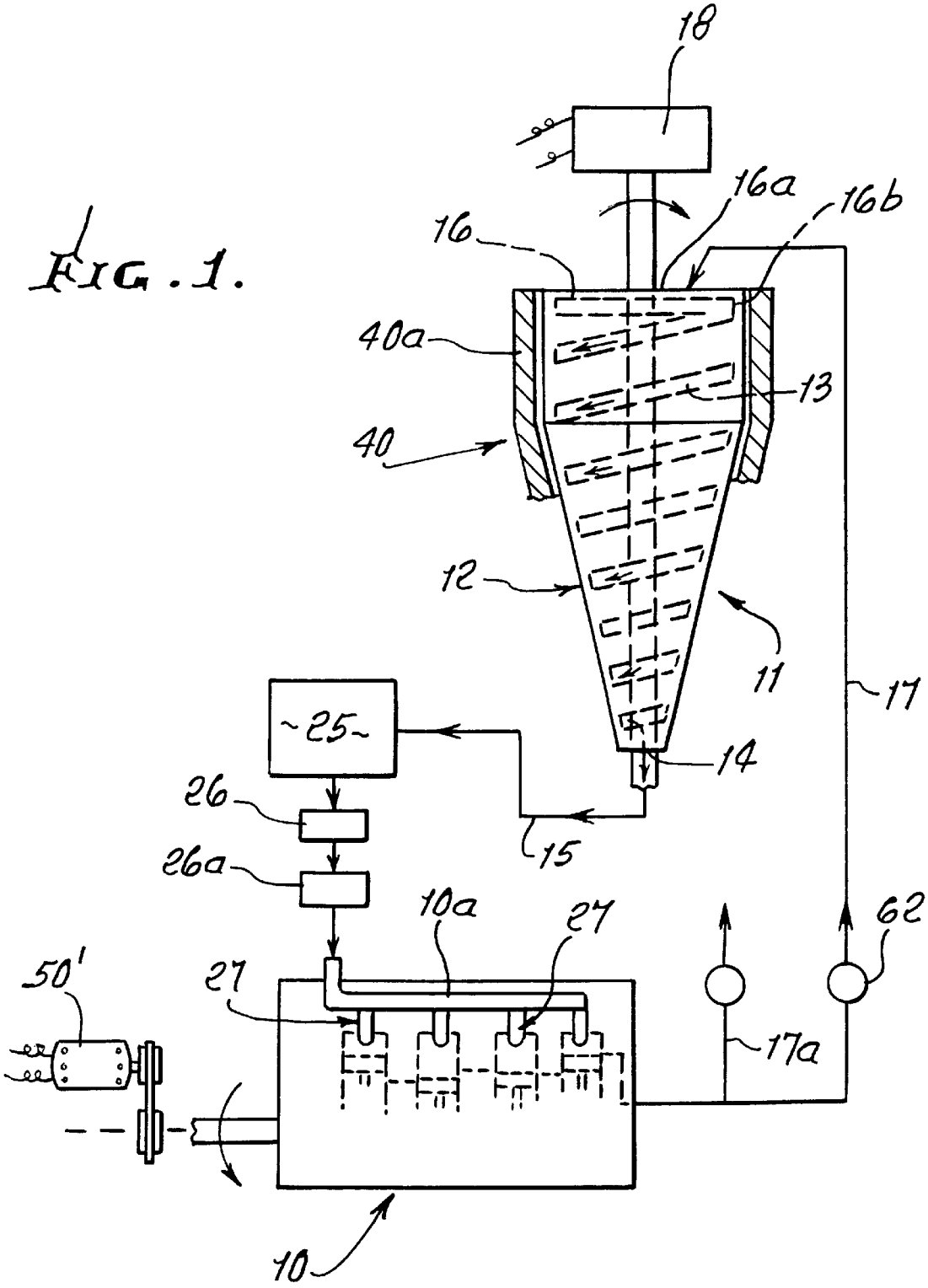
FIG. 1 is a system diagram.

In a preferred embodiment, the following are provided:

1) An engine (piston or rotary) 10, seen in FIG. 1, to receive air at high pressure $p_1$ preferably about 3,000 psi, to drive the pistons, etc. and to exhaust air at low pressure $p_2$, at between 150 and 250 psi and preferably about 187 psi;

2) The low pressure exhaust air is then re-pressurized, and re-fed to the engine intake;

3) A re-pressurizer generally shown at ll, includes:

i) rotating conical body 12 having an internal spiral groove 13, or channel inward of its outer wall, the groove having decreasing radial dimension, along its length, ii) an outlet 14 from the groove, from which high pressure air is delivered to duct 15, that extends directly to the engine intake manifold 10*a*; alternatively, duct 15 extends to a high pressure storage zone in tank 25; and air is delivered via a regulator 26, or series regulators 26 and 26*a*, and at reduced pressure $p_2$ to injectors 27 that are cam shaft operated to sequentially inject pressurized air into cylinders above the pistons, to drive the pistons; timed as in hydrocarbon fuel engines;

iii) An impeller 16 that rotates with the body 12; the impeller intake or "eye" 16*a* receives the low pressure engine exhaust air, as via duct 17. The impeller radial outlet 16*b* delivers air to the top input 13*a* to channel 13;

iv) the radial depth dimension of the spiral channel 13 decreases along the length of the body, to progressively reduce the cross-sectional area of the channel, to pressurize and reduce the volume of the air as it is forced to flow along the channel length, toward axial outlet 14. The channel radius decreases until it merges with the bore 13*b* of outlet duct 15. The channel axial depth is constant, along the length of body 12.

4) A drive 18 rotates the body 12 at very high speed, for example between 12,000 to 15,000 RPM. Drive 18 may comprise an electrical motor;

5) Energy output from the engine 10 may be used as a source for at least part of the energy necessary to operate the motor 18, as via a crankshaft driven generator 50';

6) In the case of a piston type engine 10, the intake and discharge valves to the cylinders may be cam shaft driven, in the same way as in an automobile engine.

Figure 2:
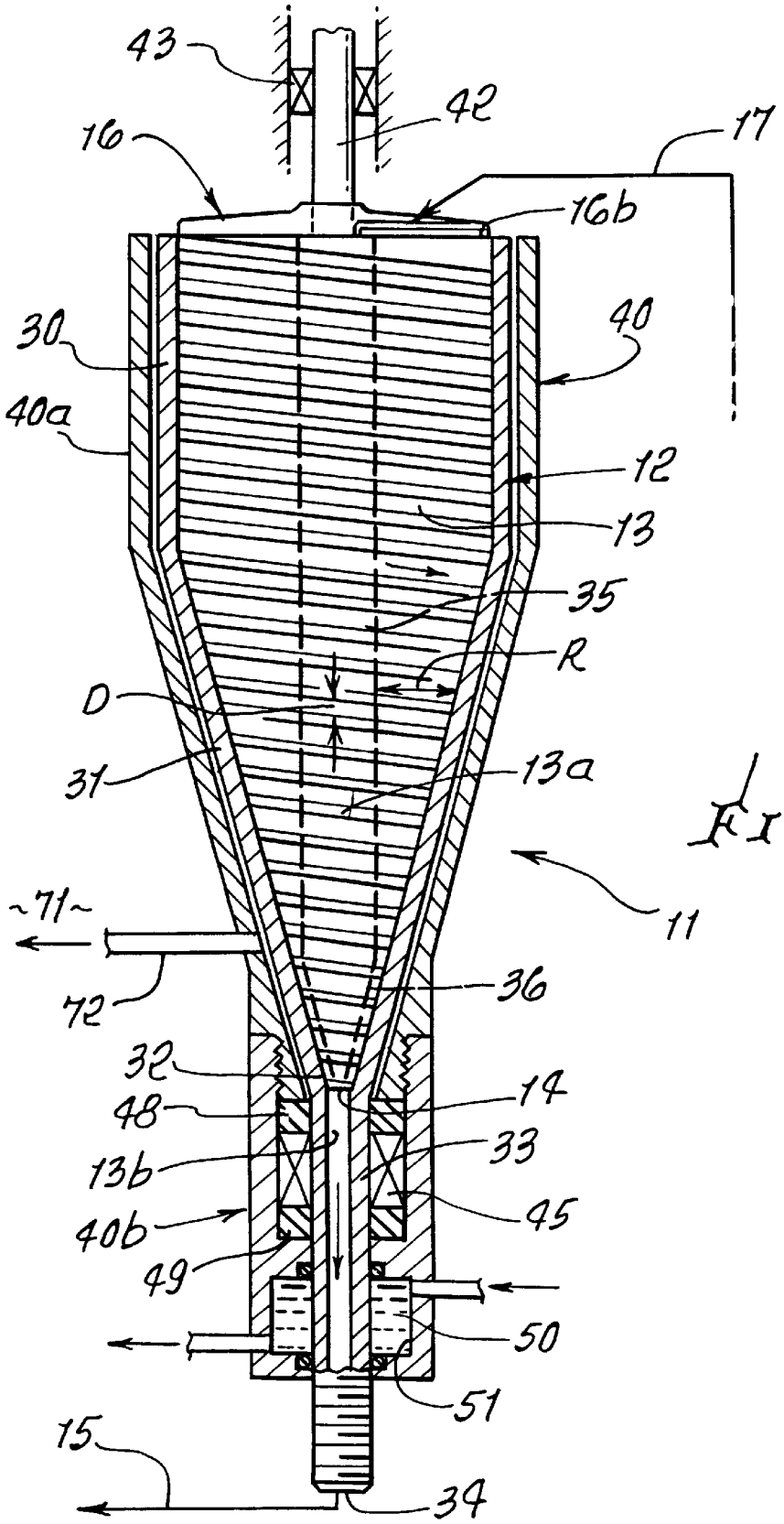
FIG. 2 is an elevation taken in axial section through a pressurizer as shown schematically in FIG. 1.
Figure 4:
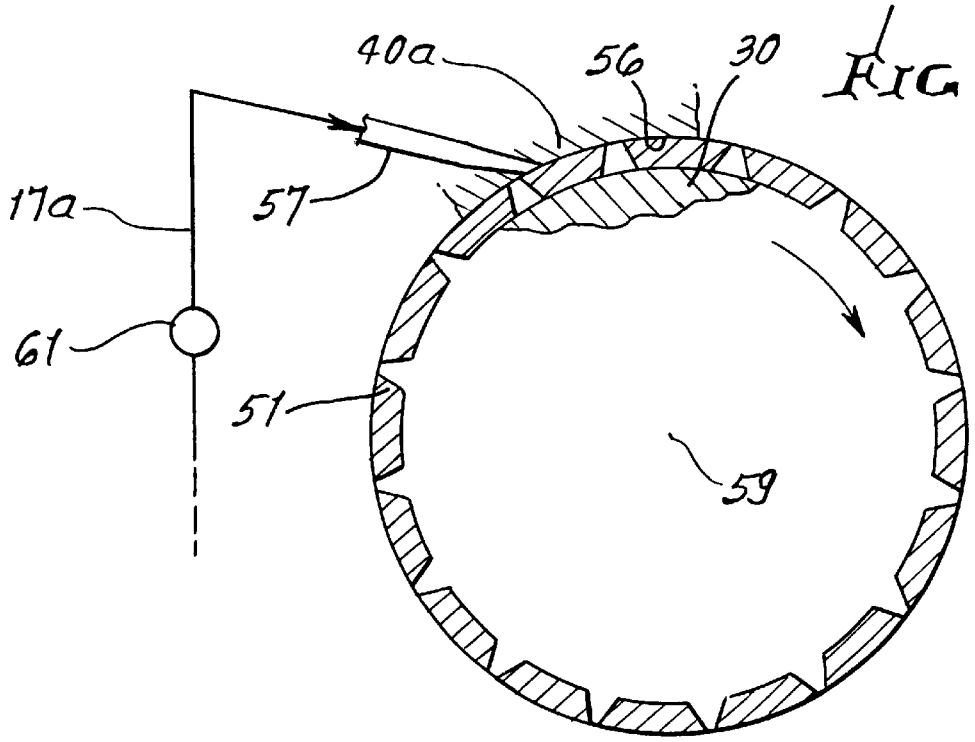
FIG. 4 is a horizontal section taken on lines 4—4 of FIG. 3.
Figure 3:
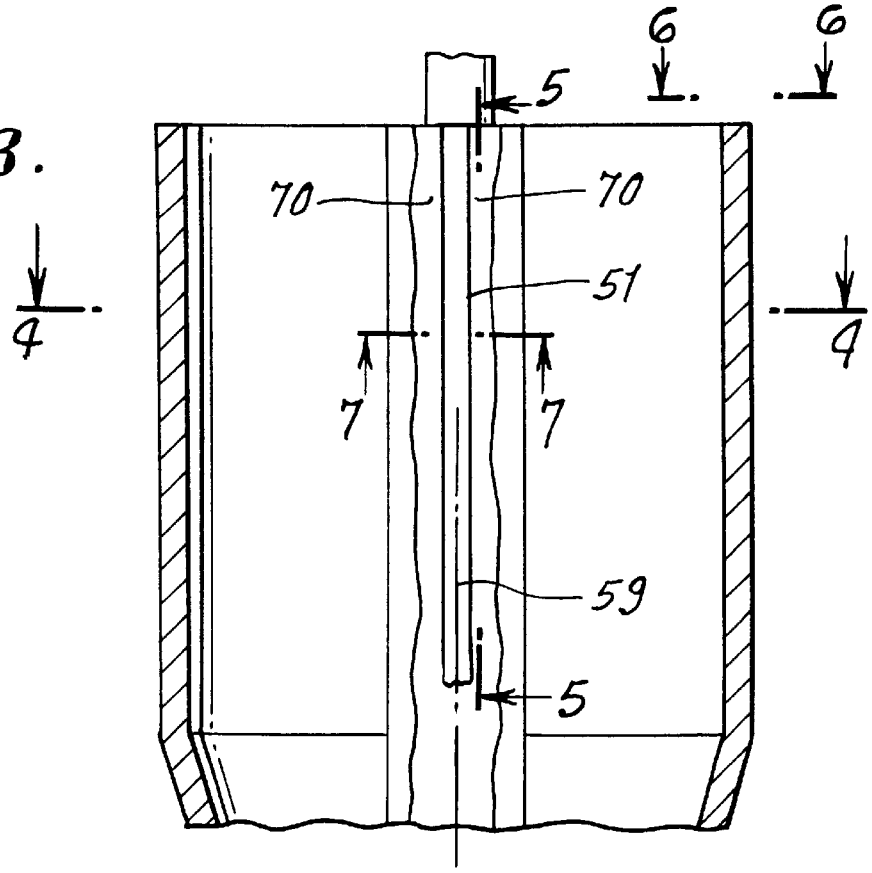
FIG. 3 is a vertical section showing a vane on the pressurizer body to receive gas pressure thrust, for assisting in rotating the body.
Figure 5:
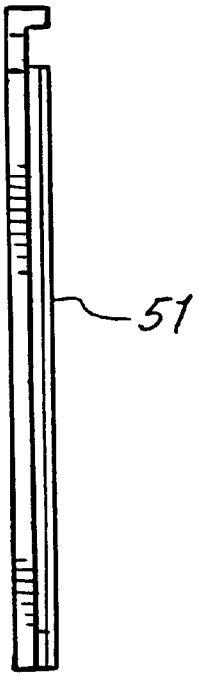
FIG. 5 is an elevation taken on lines 5—5 of FIG. 3.

As shown in FIG. 2, the rotating body 12 has an upper cylindrical wall 30 above and connected to a lower conical wall 31. Spiral groove 13 originates in the upper interior of the body surrounded by wall 30, and spirals downwardly to merge with lower groove extent 13*a* surrounded by wall 31. The outer diameter of the groove reduces as the groove spirals downwardly, to terminate at 32. Below the latter, body tubular duct 33 conducts pressurized air to outlet 34.

Groove channel 13 has an inner diameter terminating at a central and axial cylindrical wall 35 extending downwardly within the bounds of walls 30 and 31, and terminating at tapered wall 36 extending downwardly toward 32. Therefore the groove radial extent as measured between the inner diameter of cylindrical wall 30 and wall 35 remains constant, and centrifugal force transmitted to air in the groove increases air pressure which urges pressurized air flow along the groove and downwardly. Below the lowermost level of wall 30, the groove radial dimension R gradually reduces, whereas the groove vertical depth D remains the same. Accordingly, the groove cross-sectional area A gradually reduces, increasingly and efficiently compressing the air in a downward flow direction of the air in the spiraling groove and also by virtue of reduction in radius of the groove from the body axis. Air discharges via 13*b* to duct 15.

An outer non-rotary housing 40 contains the rotating body 12, and has upper and lower sections 40*a*and 40*b*. A rotary drive shaft 42 extends downwardly from the drive motor 18, through appropriate upper bearings 43. Shaft 42 is connected to body 12. Lower thrust and radial bearings 45 within housing section 40*b* support and center the body lower duct or tube 33. Annular seals are provided at 48 and 49. Coolant 50 is confined within a chamber 51 in body section 40*b*, and in contact with tube 33, to conduct heat from the tube and bearings 45.

Figure 6:
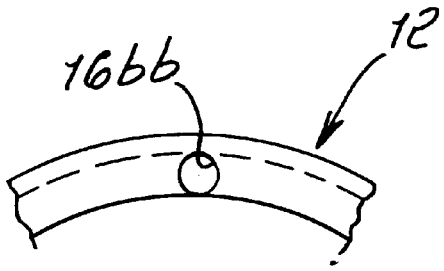
FIG. 6 is a fragmentary view taken on lines 6—6 of FIG. 3.
Figure 7:
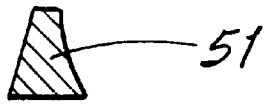
FIG. 7 is an enlarged cross-section taken through a vane.

FIGS. 3, 4, 5 and 7 show provision of a pneumatic rotary drive for the body 12 upper wall 30. That drive includes upright vanes 51 that are carried by body 12 and extend radially outwardly into close relation to the bore 56 of section 40*a*. Compressed air from a duct 57 is fed to the vertical spaces between the vanes 51 to impel them in a rotary direction with body 12 about central vertical axis 59. This supplements the rotary drive provided by shaft 42, and adds efficiency, since the source of the compressed air supplied by duct 57 is typically the exhaust air from the engine 10, i.e. flowing from duct 17, and via branch duct 17*a* seen in FIG. 1. Valves 61 and 62 in 17 and 17*a* may be adjusted to control the relative supply of exhaust air, at reduced pressure, to duct 57 and to inlet 16*a*. Compressed air supplied to vanes 51, as described, flows downwardly between body 12 and the housing, as in the spaces 70 therebetween, and then to the exterior, as indicated at 71 in FIG. 2, via an outlet 72. FIG. 6 shows inlet 16*bb* to the groove 13, at the upper end of that groove.

Figure 8:
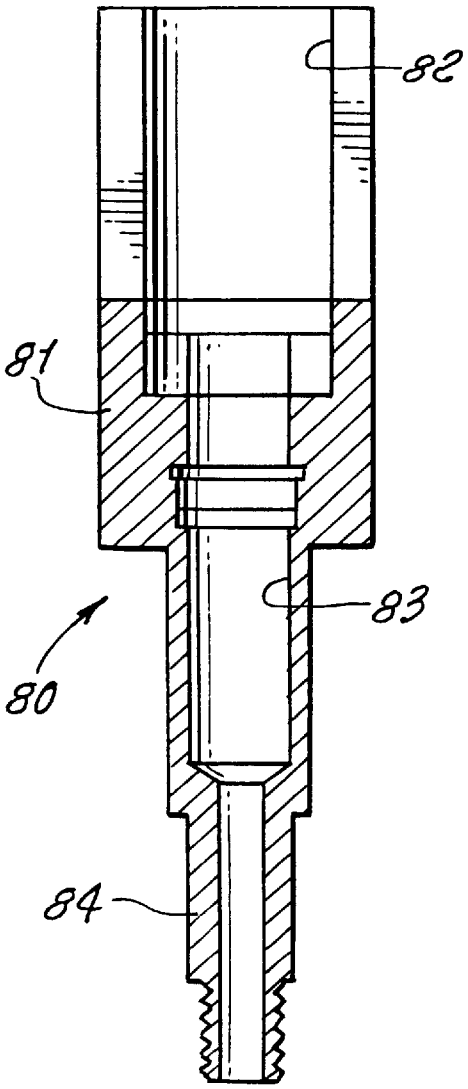
FIG. 8 is a section taken through an injector body.
Figure 9:
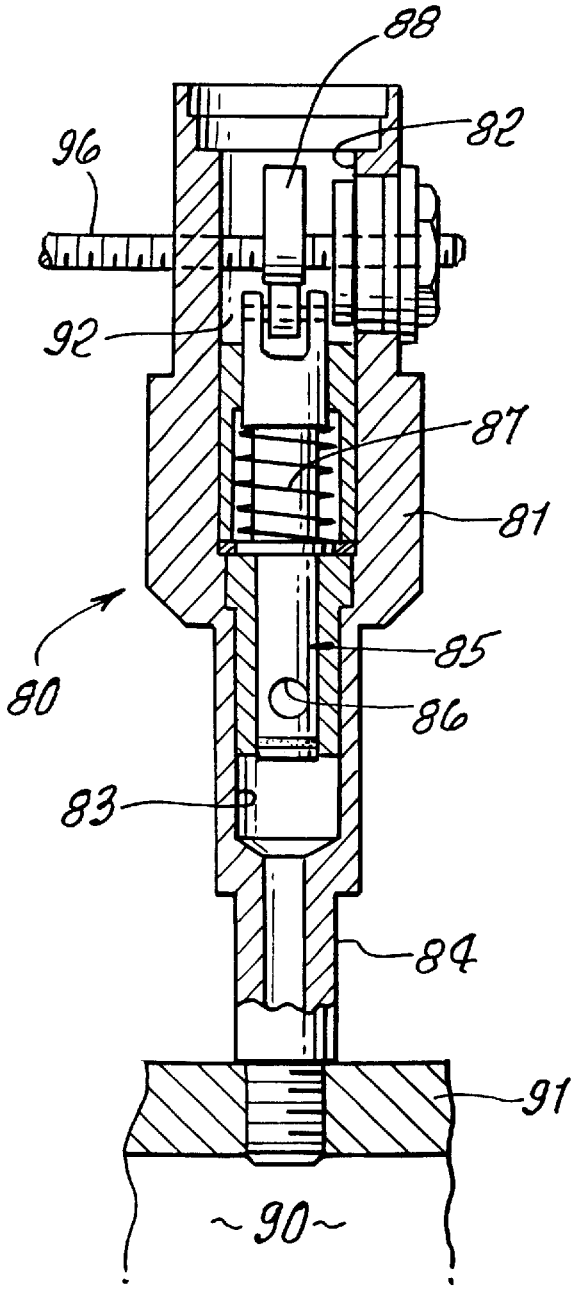
FIG. 9 is a view like FIG. 8 showing a reciprocating plunger in the injector body.

An air injector 80 for injecting compressed air into an engine cylinder is seen in FIGS. 8 and 9. It includes a body 81having a upper bore 82, a lower bore 83, and an outlet duct 84. A plunger 85 is received in bores 82 and 83, and is movable downwardly to pass air to duct 84 via a port 86, and upwardly to close off such air flow, as by blanking of port 86. A coil spring 87 in bore 83 urges the plunger upwardly. A cam lobe 88 rotates to urge the plunger downwardly, once each cam lobe rotation. Duct 84 communicates with the upper interior 90 of the engine cylinder 91 to supply compressed air to drive the piston downwardly.

Air pressure from storage zone in tank 25 is supplied to the injector chamber 92 bounded by bore 82, as via the regulators 26 and 26*a*, as referred to. Tank air pressure is for example at about 3,700 psi; the first regulator 26 drops the pressure to about 187 psi; and the second regulator dips the pressure to between 40 psi and 175 psi. That pressure is supplied to the injectors. Timing of the injectors may be controlled by cam shaft 96 rotation, for compressed air to be supplied to the four cylinders of a four cylinder engine in the sequence 1-3-4-2.

I claim:

1. Apparatus for supplying high pressure gas to an engine, to operate the engine, comprising, in combination:

a) a gas pressurizer having a low gas pressure inlet to receive inlet gas as for example discharge gas from the engine, and a high gas pressure outlet to deliver compressed supply gas at high pressure to the engine, b) said pressurizer including a rotary body defining a gas flow channel that extends in a spiral of decreasing radius about an axis, and c) a drive, including a pneumatic drive spaced outwardly of and extending about said channel and operatively connected with said body to rotate the body about said axis, at high velocity, thereby to effect gas flow and pressure increase, along the channel, for supply to the engine via an outlet from said pressurizer, d) and including said engine connected to said pressurizer and receiving said compressed supply gas.

2. The combination of claim 1 wherein said body is generally conical, about said axis, and the channel cross-sectional area also decreases along the channel length.

3. The combination of claim 1 wherein the drive includes an electric motor that drives the body at RPM in excess of 12,000.

4. The combination of claim 1 including an impeller associated with said pressurizer to receive low pressure gas and to pressurize and deliver said gas to said channel, to flow therealong.

5. The combination of claim 1 including a high pressure gas storage zone receiving gas from said pressurizer outlet.

6. The combination of claim 5 including at least one gas pressure regulator receiving gas from said high pressure storage zone to reduce the pressure of gas supplied to the engine.

7. The combination of claim 1 wherein said engine has pressurized air injectors receiving pressurized flow via at least one regulator, said injectors connected to the engine to periodically deliver pressurized air to the engine cylinders to drive engine pistons.

8. The combination of claim 1 wherein said body has a cylindrical section and a tapered section, the spiral channel extending in both said sections whereby air is preliminarily pressurized in the spiral channel in the cylindrical section, and air is subsequently pressurized to substantially higher level in said tapered section, the channel having a cross sectional area in said cylindrical section that is substantially constant, and the channel having a cross-sectional area that decreases along the channel length in said tapered sections wherein the radius of the channel also decreases.

9. Apparatus for supplying high pressure gas to an engine, to operate the engine, comprising, in combination:

a) a gas pressurizer having a low gas pressure inlet to receive inlet gas as for example discharge gas from the engine, and a high gas pressure outlet to deliver compressed supply gas at high pressure to the engine, b) said pressurizer including a rotary body defining a gas flow channel that extends in a spiral of decreasing radius about an axis, and c) a drive operatively connected with said body to rotate the body about said axis, at high velocity, thereby to effect gas flow and pressure increase, along the channel, for supply to the engine via an outlet from said pressurizer, d) the drive including an electric motor that drives the body at RPM in excess of 12,000, e) and wherein the drive includes a pneumatic drive operatively connected to said body.

10. The combination of claim 9 wherein said pneumatic drive includes vanes positioned on said body to receive pressurized air thrust.

11. The combination of claim 10 wherein said impeller is connected to said drive to be rotated by the drive.

12. The combination of claim 11 including said engine, to which air discharged from said body channel is supplied to operate the engine.

13. The combination of claim 12 including ducting receiving air at reduced pressure discharged from the engine, and to supply said air to said pressurizer inlet.

14. The combination of claim 10 including said engine to which air discharged from said body channel is supplied to operate the engine, and including ducting receiving air at reduced pressure discharged from the engine, and to supply said air to said pressurizer inlet.

* * * * *